US011963608B2

(12) United States Patent
Sala

(10) Patent No.: US 11,963,608 B2
(45) Date of Patent: Apr. 23, 2024

(54) ORAL HYGIENE BRUSH, WITH A BRISTLE HEAD REPLACEMENT SYSTEM

(71) Applicant: Marli Sala, São Paulo (BR)

(72) Inventor: Marli Sala, São Paulo (BR)

( * ) Notice: Subject to any disclaimer, the term of this patent is extended or adjusted under 35 U.S.C. 154(b) by 0 days.

(21) Appl. No.: 17/805,029

(22) Filed: Jun. 2, 2022

(65) Prior Publication Data

US 2023/0092043 A1 Mar. 23, 2023

(30) Foreign Application Priority Data

Sep. 22, 2021 (BR) ..... 10 2021 018859 6

(51) Int. Cl.

| | |
|---|---|
| ***A46B 9/04*** | (2006.01) |
| ***A46B 5/00*** | (2006.01) |
| ***A46B 7/04*** | (2006.01) |
| *A46B 5/02* | (2006.01) |

(52) U.S. Cl.

CPC ..... *A46B 7/042* (2013.01); *A46B 9/04* (2013.01); *A46B 5/00* (2013.01); *A46B 5/02* (2013.01); *A46B 2200/1066* (2013.01)

(58) Field of Classification Search

CPC ..... A46B 5/0095; A46B 9/04; A46B 7/042
See application file for complete search history.

(56) References Cited

U.S. PATENT DOCUMENTS

| | | | | |
|---|---|---|---|---|
| 4,592,109 | A * | 6/1986 | Borea | A46B 5/02 40/314 |
| 5,875,510 | A * | 3/1999 | Lamond | A46B 5/0095 15/176.6 |
| 8,448,287 | B2 * | 5/2013 | Ponzini | A61C 17/222 15/176.1 |
| 8,875,335 | B2 * | 11/2014 | Kloster | A61C 17/3418 15/22.1 |
| 9,597,169 | B2 * | 3/2017 | Hall | A61C 17/222 |
| 9,724,180 | B1 * | 8/2017 | Liu | A46B 5/0095 |
| 10,603,147 | B2 * | 3/2020 | Bloch | A46B 7/04 |
| 10,905,533 | B2 * | 2/2021 | Zhou | A46B 11/063 |
| 2017/0208930 | A1 * | 7/2017 | Chen | A46B 7/044 |
| 2018/0325251 | A1 * | 11/2018 | Lin | A46B 5/0095 |
| 2021/0289930 | A1 * | 9/2021 | Wagner | A61C 17/222 |
| 2022/0015532 | A1 * | 1/2022 | Lu | A46B 9/04 |

* cited by examiner

*Primary Examiner* — Michael D Jennings
(74) *Attorney, Agent, or Firm* — Patshegen IP; Moshe Pinchas

(57) ABSTRACT

A toothbrush with a system to replace the bristle head. The present invention patent application follows, for a toothbrush, aimed at oral hygiene, which through a male coupling formed by a tongue with claw, both incorporated in the bristle head, which will couple in the female cavity of the handle, so that with the bristle lifetime end due to its wear, the head can be removed and replaced, providing economy, as well as less environmental impact.

3 Claims, 4 Drawing Sheets

ORAL HYGIENE BRUSH, WITH A BRISTLE HEAD REPLACEMENT SYSTEM

FIELD OF INVENTION

This invention relates to a toothbrush

BACKGROUND OF THE INVENTION

As is known in the state of the art, brushes for oral hygiene are extremely important in people's daily use, and because of this the industry moves a large load of raw material only in this segment, which in a second moment, this same material end up being discarded entirely in the environment.

According to an article written by journalist SERGIO RIPARDO, published by Folha Online in June 2001, Brazil sold, at the time, about 120 million toothbrushes a year, considering that each toothbrush weighs around 16 grams, in twelve months, 1,920 tons of polymeric waste are generated with toothbrushes in Brazil.

Considering that in 2001 Brazil had 177 million inhabitants, and having today, approximately 225 million inhabitants, we can increase this disposal to 152 million toothbrushes, which corresponds to 2,440 tons/year or 2,440,000 (two million four hundred and forty thousand kilos) of plastic/year.

As an example of products commonly found on the market, we can mention the patent document "BR 20 2014 018742 7", entitled "COMPACT DEVICE FOR MOUTH HYGIENE WITH REPLACEABLE COMPONENTS" which demonstrates an acrylic box set that helps protecting the bristles when they are not in use and is also the body of the brush, fitting around the neck. The brush head and neck are made of plastic and nylon bristles which are installed in their perforations. It is embedded in a neck that is also plastic. The dental floss refill is replaceable and formed by a plastic cylinder wrapped in thermoplastic resin wire. The refill holder detaches from the rest of the protective case, for better refill replacement. The top acrylic lid with two sides, also made of acrylic, forms the refill holder that contains two pins for attaching, by pressure, the dental floss refill.

SUMMARY OF THE PRESENT INVENTION

In order to solve such inconveniences, the inventor developed the present invention patent application, where a toothbrush, aimed at oral hygiene, which through a male coupling formed by a tongue with claw, both incorporated in the bristle head, which will mate in the female cavity of the handle. Thus, with the wear of the bristles promoted as a result of use, the head is removed and replaced keeping only the handle, thus promoting savings, as well as less environmental impact.

This project aims to mitigate the significant amount of plastic discarded annually, considering that the handle of a toothbrush weighs approximately 10 grams and the bristle head 6 grams, we are talking about eliminating the disposal of 1,525 tons of plastic/year. In addition to this environmental impact, we will have considerable financial savings in the purchase of the toothbrushes since the average unit value of a complete brush is around R$ 4.00 (four reais in brazilian currency). In other words, we are talking about reversing the cost to only R$ 1.50 (one real and fifty cents) considering the replacement of the brush head only, and thus, with this significant drop in cost, people will also be induced to change the brush in a shorter period of time, causing, thus, a more effective oral hygiene/health.

BRIEF DESCRIPTION OF THE DRAWINGS

The present invention patent application follows, to be better explained according to the attached drawings, in which can be seen.

DETAILED DESCRIPTION OF THE PREFERRED EMBODIMENT

Figure 1:
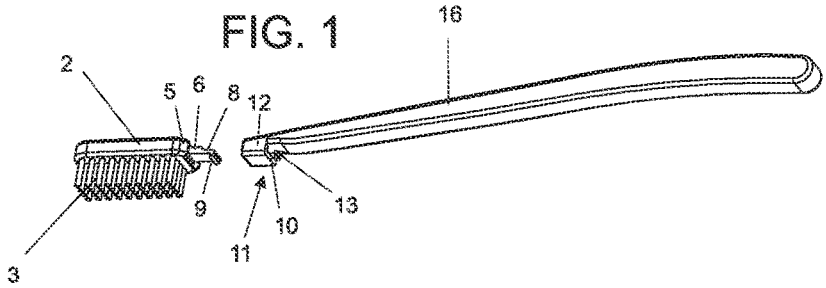
FIG. 1—Lower perspective view, showing the brush bristle head detached from the handle, where its male terminal formed by a tongue with claw, aligns with the female terminal of the handle, formed by a through hole delimited by the lower edge wall and side edges.
Figure 2:
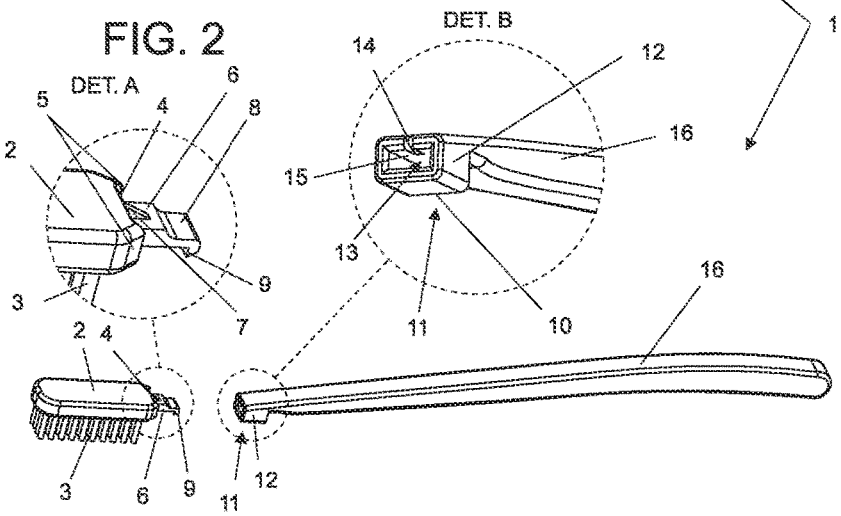
FIG. 2—Upper perspective view according to the previous figure, demonstrating its means of fitting, both represented in an enlarged way by details A and B.
Figure 3:
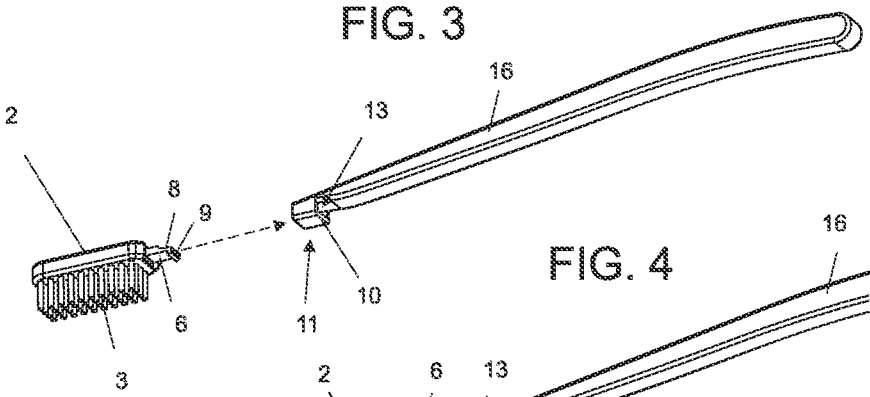
FIGS. 3, 4 and 5—Sequential view showing the coupling of the head to the handle female terminal.
Figure 4:
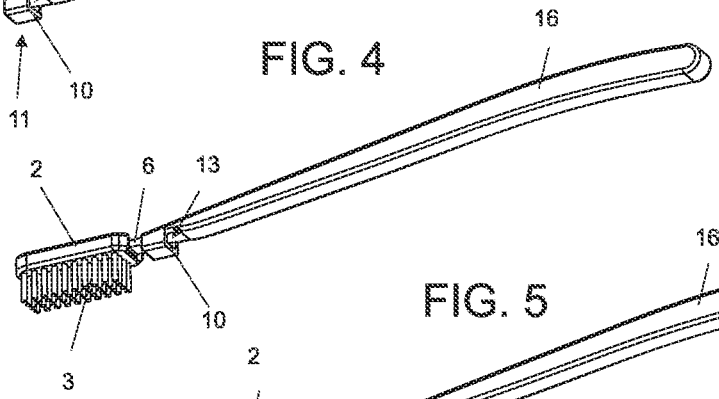
Figure 5:
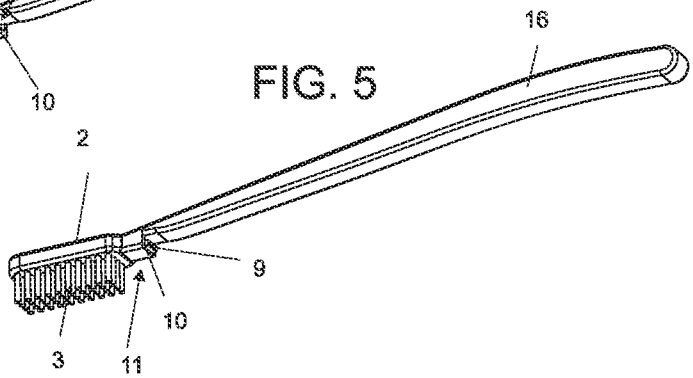
Figure 6:
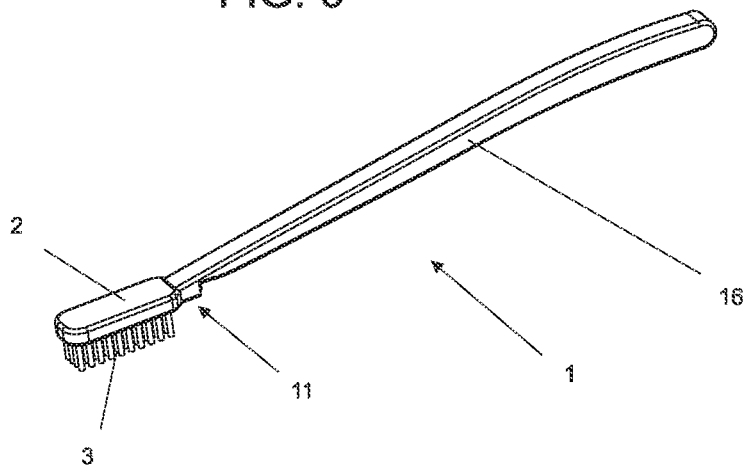
FIG. 6—View of the brush properly assembled for use.
Figure 7:
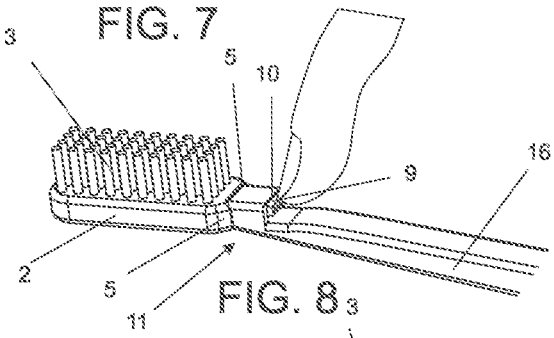
FIGS. 7, 8 and 9—Schematic view showing the user pressing the claw, which is forced to move, thus providing its disengagement from the lower stop, allowing the bristle head to be fully removed and discarded.
Figure 8:
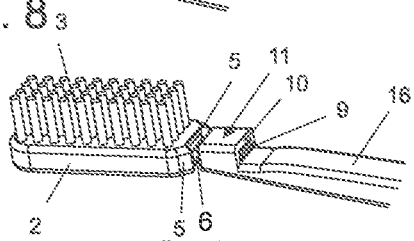
Figure 9:
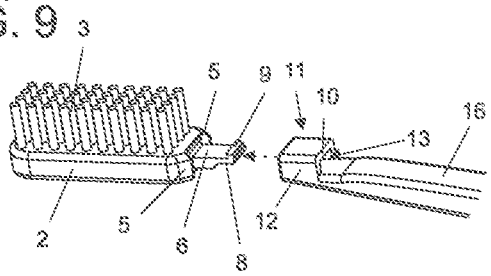

In compliance with the attached drawings, the present invention patent application follows, for an "ORAL HYGIENE BRUSH, WITH A BRISTLE HEAD REPLACEMENT SYSTEM", formed from a toothbrush (1) equipped with a head (2) with bristles (3), and from its rear edge (4) project a pair of ears (5) that intermediate a male terminal formed by a tongue (6) reinforced by a structural rib (7), while step, which at its end, an indentation (8) is intended for a claw (9). This, in turn, coincides with the lower stop (10) of a female terminal (11), formed by side walls (12), which make up a through channel (13) as well as a chamfered cutout (14), arranged on the upper wall (15) of said female terminal (11), so that a handle (16) projects from the said upper wall (15).

Thus constituted, for the assembly, the user introduces the tongue (6) of the head (2) in the through channel (13), which under slight deformation in the setback (8), makes the tongue (6) have its jaw (9) placed at the end of the course in the lower stop (10) of the female terminal (11). Simultaneously, the structural rib (7) is housed inside the chamfered cutout (14), as well as the ears (5) start to wedge the edges of the side walls (12) of said female terminal (11), causing in this condition, the perfect locking of the head (2) on the handle (16), enabling its use.

As the bristles (3) wear out, the user presses the claw (9), which moves in a forced way, in the direction of disengaging from the lower stop (10), allowing the head (2) to be removed and discarded.

According to the scope of the present application, with the wear of the bristles (3) on the head (2), both are removed and discarded, while the original handle (16) is maintained, and therefore, the plastic material discard rate in nature becomes considerably smaller, in addition to promoting low cost for the final consumer.

The invention claimed is:

1. A toothbrush comprising:

a head (2) with bristles (3), said head includes a pair of ears projected from a rear edge of said head, and a male terminal protruding between said ears, said male terminal includes a tongue (6) reinforced by a structural rib (7);

an indentation (8) extending from said tongue and including a claw;

a handle including female terminal (11), defined on a front edge, said female terminal (11) includes a through channel (13) defined by by side walls (12) and an upper wall including a chamfered cutout (14), said channel (13) defines a lower stop (10);

wherein said male terminal is configured to be inserted inside said female terminal (11), such that structural rib engages said chamfered cutout and said claw (9) engages said lower stop (10).

2. The toothbrush according to claim 1, wherein the indentation (8) is configured to pressed upwardly such that said claw (9) is accommodated inside said channel (13) until reaching the lower stop (10); and wherein edges of the side walls (12) of said female terminal (11) are wedged by the ears (5), locking thereby the head (2) to the handle (16).

3. The toothbrush according to claim 1, wherein the claw (9) is configured to be pressed upwardly such that when the claw (9) is locked by said lower stop (10), pressing the claw upwardly causes the disengagement from the lower stop (10) allowing thereby the head (2) to be removed from said handle.

* * * * *